US006453951B1

(12) United States Patent
Kuwabara

(10) Patent No.: US 6,453,951 B1
(45) Date of Patent: Sep. 24, 2002

(54) PIVOTABLE HEDDLE FOR A LOOM

(75) Inventor: Junichi Kuwabara, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/022,251

(22) Filed: Dec. 20, 2001

(30) Foreign Application Priority Data

Mar. 28, 2001 (JP) ..... 2001-091824

(51) Int. Cl.[7] ..... D03D 29/00; D03D 49/62
(52) U.S. Cl. ..... 139/33; 139/93
(58) Field of Search ..... 139/93, 94, 33

(56) References Cited

U.S. PATENT DOCUMENTS 1,160,132 A * 11/1915 Bliss ..... 139/33
1,277,927 A * 9/1918 Heiss ..... 139/33
2,047,511 A * 7/1936 Kaufmann ..... 139/92
4,046,172 A * 9/1977 Russell ..... 139/33
4,462,432 A * 7/1984 Sajo et al. ..... 139/33
4,784,187 A * 11/1988 Murayama et al. ..... 139/33

FOREIGN PATENT DOCUMENTS

JP 10-046442 2/1998 ..... D03C/9/02
JP 2001-003240 1/2001 ..... D03D/29/00

* cited by examiner

*Primary Examiner*—Andy Falik
(74) *Attorney, Agent, or Firm*—Michael D. Bednarek; Shaw Pittman LLP

(57) ABSTRACT

A heddle includes a plurality of passages spaced from each other in a first direction for guiding warps, respectively, and a retainer provided in each of the passages for retaining a corresponding warp. Each of the guide passages is defined between a first surface and a second surface. The retainer includes an upper projection extending between the first surface and the second surface, and a lower projection extending between the first surface and the second surface. The upper projection and the lower projection define a warp retaining space which is accessible from the guide passage via a clearance.

18 Claims, 12 Drawing Sheets

PIVOTABLE HEDDLE FOR A LOOM

BACKGROUND OF THE INVENTION

1. Field of the Invention

The present invention relates to a heddle used, for example, in a hand-weaving loom for lifting or lowering a plurality of warps for forming a shuttle passage between the warps. The present invention also relates to a loom provided with such a heddle.

2. Description of the Related Art

A loom provided with a heddle is conventionally used for hand-weaving a fabric for example. FIG. 17 illustrates an example of prior-art heddle for moving a plurality of warps W (Wa, Wb). The illustrated heddle H1, which is of a lifting type, includes an elongate frame 90 and a plurality of guide bars 91. The guide bars 91 are attached to the frame 90 as arranged longitudinally of the frame 90 with a clearance 92 provided between two adjacent guide bars 91. Each of the guide bars 91 is formed with a guide hole 93. Each of the warps W (Wa, Wb) is guided into a respective one of the clearances 92 or the guide holes 93. The clearances 92 are greater in length than the guide holes 93. Therefore, when the heddle H1 is lifted as shown in FIG. 18, the warps Wa guided into the holes 93 are lifted higher than the warps Wb guided in the clearances 92, thereby forming a shuttle passage 94 for introducing a shuttle 94. Though not illustrated, when the heddle H1 is lowered, the warps Wa are made lower than the warps Wb.

FIG. 19 illustrates another example of prior art heddle. The illustrated heddle H2, which is of a rotatable type, is formed with plural kinds of grooves 95A, 95B, 95C, 95D for guiding a plurality of warps W (Wc, Wd). The grooves 95A and the grooves 95B are alternately arranged on one longitudinal edge of the heddle H1, whereas the grooves 95C and the grooves 95D are alternately arranged on the other longitudinal edge of the heddle H1. Specifically, the grooves 95A, 95B are arranged in facing relationship to the grooves 95C, 95D, respectively. Note that the grooves 95A are deeper than the grooves 95B, whereas the grooves 95D are deeper than the grooves 95C.

With this structure, each of the warps W (Wc, Wd) is initially guided into a respective one of the grooves 95A or 95B. In this state, the warps Wd received in the grooves 95B are located higher than the warps Wc received in the grooves 95A. However, when the heddle H2 is rotated as shown in FIG. 20, the warps Wc in the grooves 95A enter the grooves 95C, whereas the warps Wd in the grooves 95B enter the grooves 95D. In this state, conversely to the initial state, the warps Wc are located higher than the warps Wd. By lifting or lowering each of the warps W in this way, a shuttle passage is defined.

However, the above-described prior art heddles have the following drawbacks.

First, in the heddle H1 shown in FIG. 17, the warps W (Wa, Wb) need be introduced from the tip ends thereof into the guide holes 93 or the clearances 92. However, since the guide holes 93 or the clearances 92 are relatively small or narrow, there is some difficulty in introducing the warps into the holes 93 or the clearances 92 from the tip ends. Further, for easier insertion of the warps into the guide holes 93 or the clearances 92, each of the warps W need be cut, in advance, so as to have a tip end suitable for insertion, which is troublesome and inconvenient. Moreover, the user needs to move the heddle H1 between three levels of height including the middle state shown in FIG. 17, the lifted state, and the lowered state, which is troublesome. Furthermore, the height difference h between the higher warp and the lower warp upon lifting the heddle H1 (See FIG. 18) cannot exceed the lifting amount of the heddle H1. Therefore, improvement is necessary for widening the shuttle passage 94. The above-described maximum height difference h corresponds to one half of the length of the clearances 92. Therefore, for widening the shuttle passage 94, the length of each clearance 92 need be increased, which leads to undesirable increase in size and weight of the entire heddle H1.

On the other hand, in the heddle H2 shown in FIG. 19, each of the grooves 95A–95D is open to the outside. Therefore, as compared with the above-described heddle H1, the insertion of the warps is easier. Further, since the warps W can be lifted and lowered just by rotating the heddle H2, the operation efficiency of the heddle H2 is higher than that of the heddle H1. However, since the grooves 95A–95D are open to the outside, there is a possibility that the warps W come off from the grooves 95A–95D upon rotating the heddle H2. In particular, since the grooves 95B, 95C are made shallow, the warps are more likely to come off from the grooves 95B, 95C. Moreover, in the heddle H2, the height difference of the warps W cannot exceed the difference of depth between the grooves 95A and 95B or between the grooves 95C and 95D. Therefore, similarly to the above-described heddle H1, it is difficult to widen the shuttle passage.

SUMMARY OF THE INVENTION

It is therefore an object of the present invention to provide a heddle which allows easy setting, lifting and lowering of warps while making it possible to form a wide shuttle passage without increasing the size of the heddle itself.

Another object of the present invention is to provide a loom incorporating such a heddle.

In accordance with a first aspect of the present invention, a heddle comprises a plurality of passages spaced from each other in a first direction for guiding warps, respectively, a first retainer provided in each of selected ones of the passages for retaining a corresponding warp, and a second retainer provided in each of the other passages for retaining a corresponding warp. The first retainer and the second retainer are spaced from each other in a second direction transverse to the first direction for lifting one of the first retainer and the second retainer while lowering the other of the first retainer and the second retainer when the heddle is pivoted about an axis extending in the first direction.

Preferably, the first retainer and the second retainer may be arranged alternately with each other.

Preferably, each of the guide passages may be defined between a first surface and a second surface, and each of the first retainer and the second retainer may include an upper projection extending between the first surface and the second surface, and a lower projection extending between the first surface and the second surface. In this case, the upper projection and the lower projection define a warp retaining space which is accessible from the guide passage via a clearance.

The upper projection may preferably have an inclined surface for slidably guiding the warp toward the warp retaining space. The upper projection may projects from one of the first surface and the second surface toward the other of the first surface and the second surface, whereas said other of the first surface and the second surface may be provided with a cutout for loosely receiving the upper projection. Further, the lower projection may project from one of the first surface and the second surface into contact with the other of the first surface and the second surface.

According to a preferred embodiment, each of the guide passages is defined between a first guide plate and a second guide plate, and each of the first retainer and the second retainer includes an upper projection extending between the first guide plate and the second guide plate, and a lower projection extending between the first guide plate and the second guide plate. Further, the upper projection and the lower projection define a warp retaining space which is accessible from the guide passage via a clearance.

Preferably, the upper projection has an inclined surface for slidably guiding the warp toward the warp retaining space.

Preferably, the upper projection may project from one of the first guide plate and the second guide plate toward the other of the first guide plate and the second guide plate, whereas said other of the first guide plate and the second guide plate may be provided with a cutout for loosely receiving the upper projection.

The cutout may preferably comprise a hole formed in said other of the first guide plate and the second guide plate for loosely receiving the upper projection.

Preferably, the lower projection projects from one of the first guide plate and the second guide plate into contact with the other of the first guide plate and the second guide plate. In this case, the cutout may comprise a hole formed in said other of the first guide plate and the second guide plate for snuggly receiving the lower projection.

Preferably, each of first guide plate and the second guide plate includes a top edge, a first lateral edge extending downwardly from the top edge, and a second lateral edge extending downwardly from the top edge and spaced from the first lateral edge in the second direction. In this case, the first retainer may be located adjacent the top edge and the first lateral edge while the second retainer may be located adjacent the top edge and the second lateral edge.

Preferably, each of first guide plate and the second guide plate may further include a rounded bottom edge about which the heddle is pivotable.

According to a second aspect of the present invention, there is provided a heddle comprising a plurality of passages spaced from each other in a first direction for guiding warps, respectively, and a retainer provided in each of the passages for retaining a corresponding warp. Each of the guide passages is defined between a first surface and a second surface. The retainer includes an upper projection extending between the first surface and the second surface, and a lower projection extending between the first surface and the second surface. The upper projection and the lower projection define a warp retaining space which is accessible from the guide passage via a clearance.

According to a third aspect of the present invention, there is provided a loom which comprises a frame, and a heddle supported on the frame. The heddle comprises a plurality of passages spaced from each other in a first direction for guiding warps, respectively, a first retainer provided in each of selected ones of the passages for retaining a corresponding warp, and a second retainer provided in each of the other passages for retaining a corresponding warp. The first retainer and the second retainer are spaced from each other in a second direction transverse to the first direction for lifting one of the first retainer and the second retainer while lowering the other of the first retainer and the second retainer when the heddle is pivoted about an axis extending in the first direction.

The loom may further comprise a warp winder mounted on the frame, and a fabric winder spaced from the warp winder in the second direction. The loom may additionally comprise a heddle supporting member for supporting the heddle between the warp winder and the fabric winder with the first retainer and the second retainer kept generally equal in height.

Preferably, the heddle may be movable in the second direction toward and away the fabric winder.

In a preferred embodiment, the loom further comprises a rail or rails for coming into contact with a bottom portion of the heddle for guiding the heddle in the second direction.

Preferably, the frame maybe provided with engaging means for engaging the heddle to prevent the heddle from moving in the second direction when the heddle is pivoted.

The loom may further comprise a clamp for clamping the warps from above and below to generate resistance when the warps are pulled toward the fabric winder.

Other features and advantages of the present invention will become clearer from the detailed description given below with reference to the accompanying drawings.

DETAILED DESCRIPTION OF THE PREFERRED EMBODIMENTS

Preferred embodiments of the present invention will be described below in detail with reference to the accompanying drawings.

Figure 1:
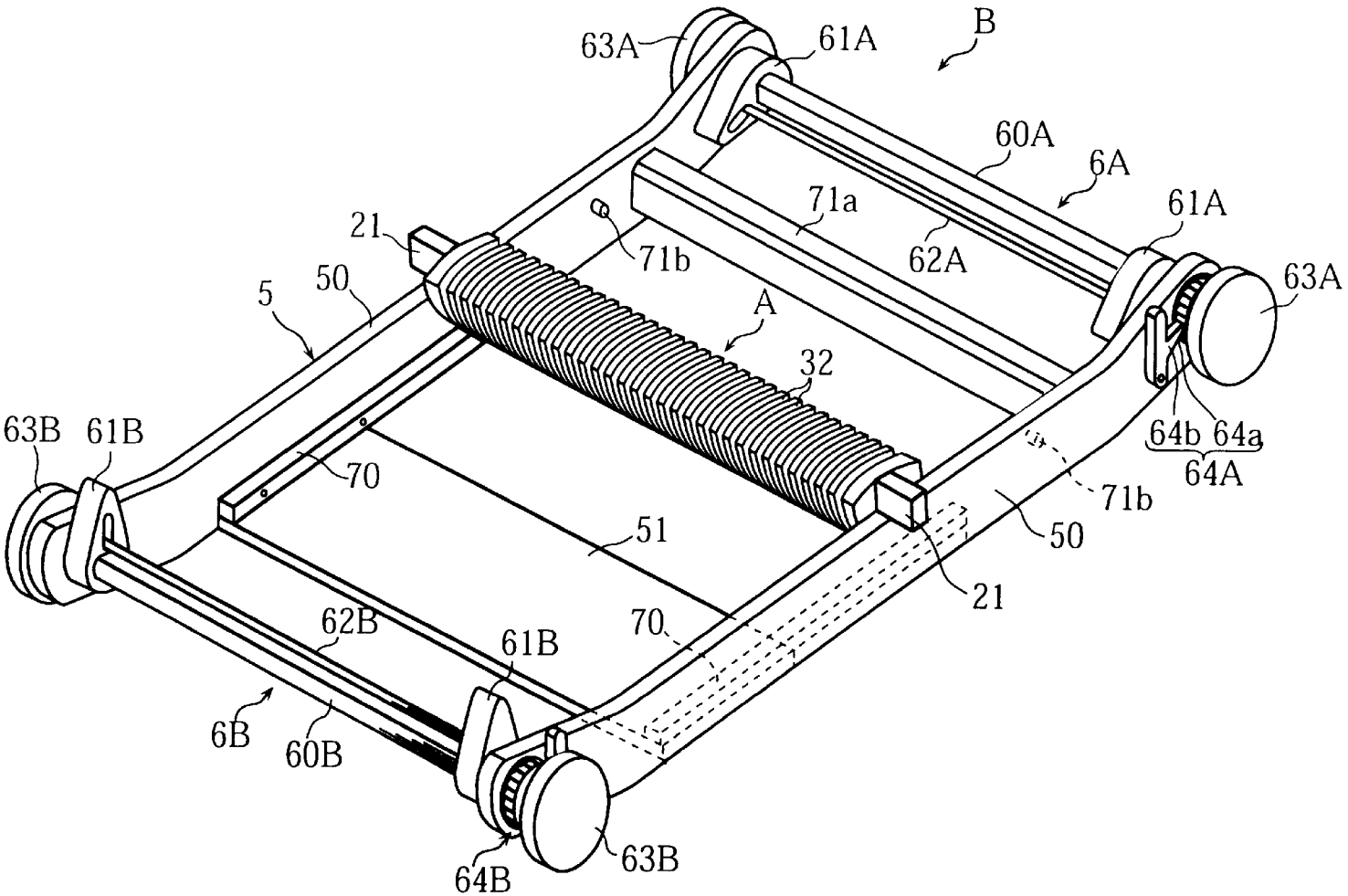
FIG. 1 is a perspective view showing a loom according to an embodiment of the present invention.
Figure 2:
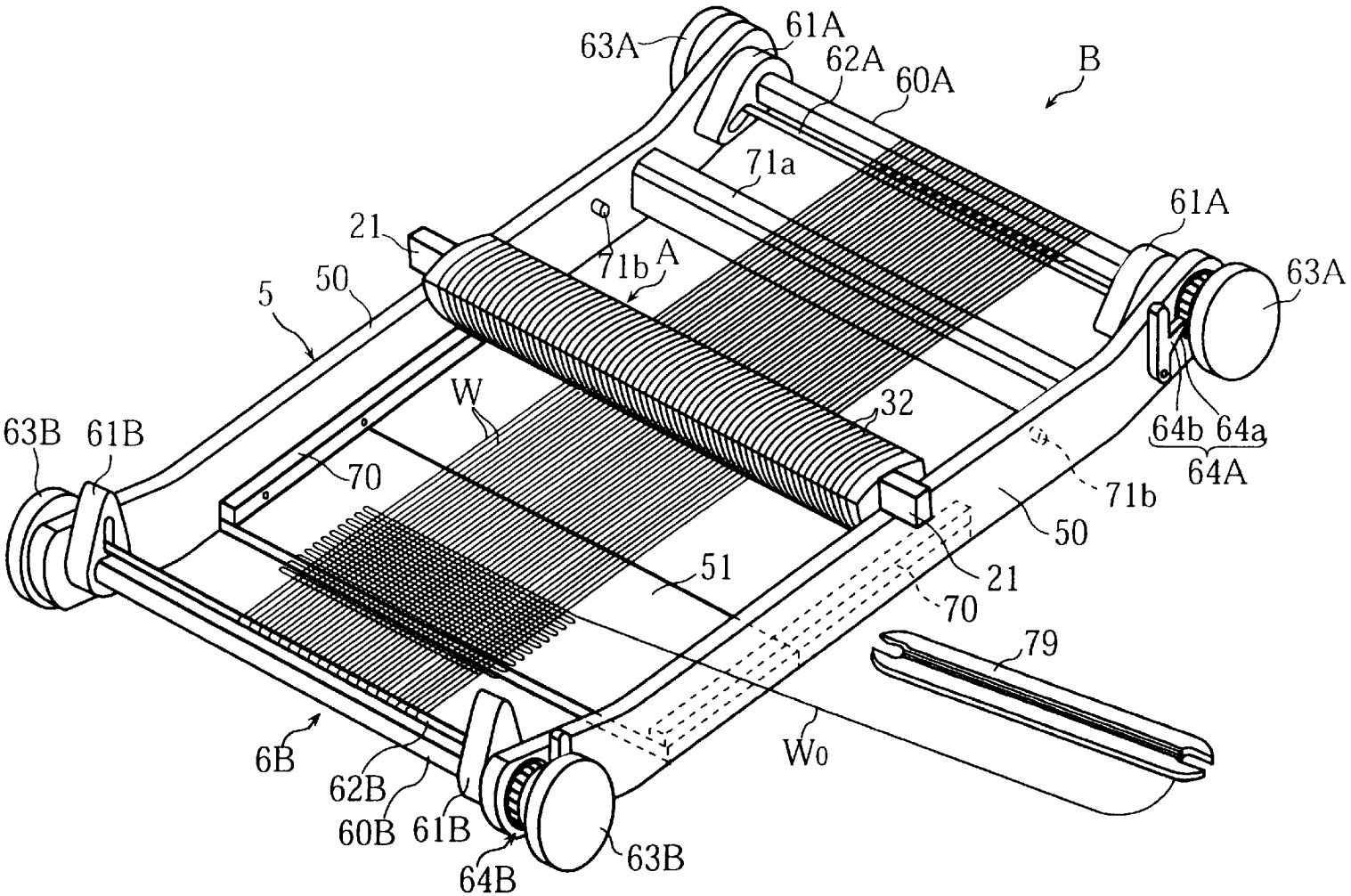
FIG. 2 is a perspective view showing the loom of FIG. 1 in use.
Figure 3:
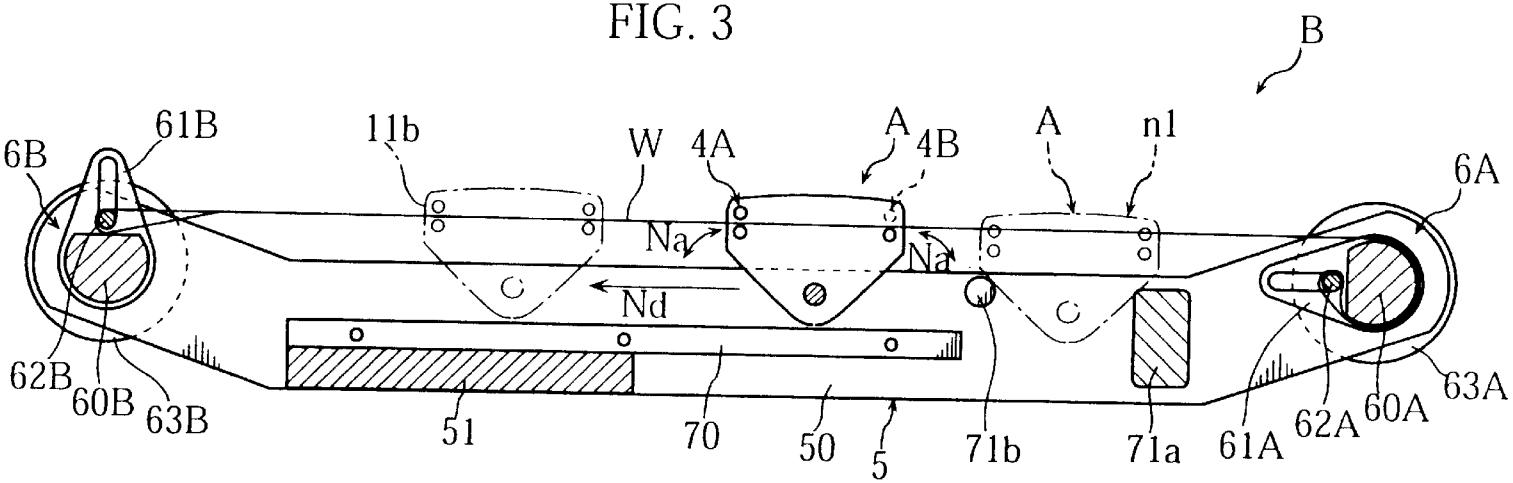
FIG. 3 is a schematic sectional view of the loom shown in FIG. 1.

FIGS. 1–3 illustrate an embodiment of a loom according to the present invention, whereas FIGS. 4-8 illustrate an embodiment of a heddle according to the present invention.

Figure 4:
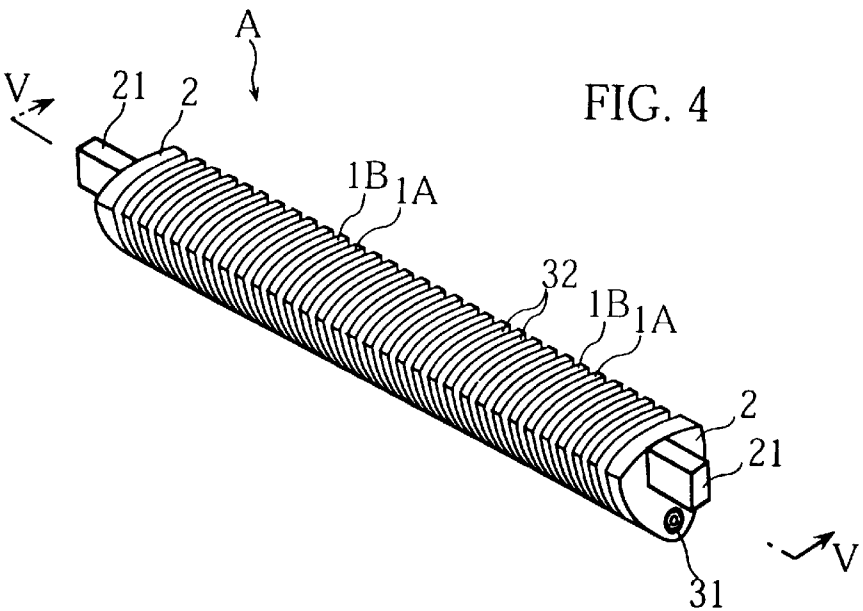
FIG. 4 is a perspective view showing a heddle according to an embodiment of the present invention.
Figure 5:
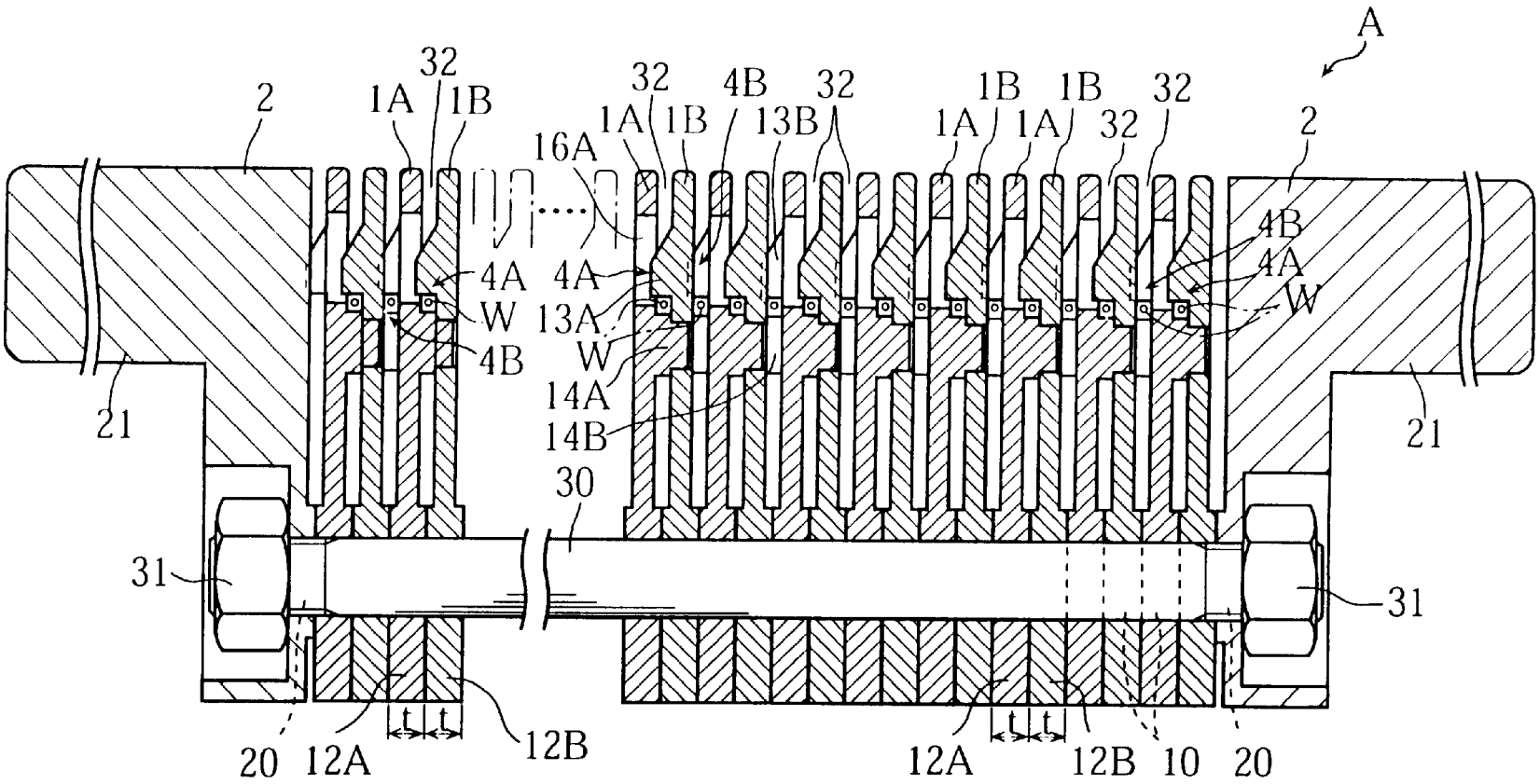
FIG. 5 is a sectional view taken along lines V—V in FIG. 4.

As clearly shown in FIGS. 4 and 5, a heddle A of this embodiment includes a plurality of first guide plates 1A and a plurality of second guide plates 1B each alternate with a respective one of the first guide plates 1A. The first guide plates 1A and the second guide plates 1B are stacked together and held between a pair of end stoppers 2.

As shown in FIG. 5, the stack of guide plates 1A, 1B and the end stoppers 2 are formed with holes 10, 20, respectively, for inserting an elongate shaft 30. The shaft 30 is formed, at longitudinally opposite ends thereof, with threaded portions for engagement with nuts 31. With this arrangement, the stack of guide plates 1A, 1B and the end stoppers 2 are connected to each other to provide a single unit as the heddle A. Each of the end stoppers 2 is formed with a generally horizontal projection 21 for manual gripping.

The guide plates 1A, 1B may be made of synthetic resin for example. Each of the guide plates 1A, 1B is formed, at the bottom thereof, with a thick-wall portion 12A, 12B of a thickness t which is larger than that of other portions. As a result, guide passages 32 for receiving warps W are defined between the guide plates 1A, 1B.

Some of the guide plates 1A, 1B may be made different in color from others. For example, a pair of guide plates 1A, 1B at the longitudinally central position of the heddle A may be made different in color from the other guide plates 1A, 1B. This enables the user to easily recognize the central one of the guide passages 32. Alternatively, the color of the guide plates 1A, 1B may change stepwise depending on the distance from the longitudinal center of the heddle. With this design, the user can utilize the color change as a rough ruler for the dimension. Alternatively, the first guide plates 1A may be made different in color from the second guide plates 1B so that plates of different colors are alternately arranged. With this arrangement, each of the guide passages 32 is defined between a pair of differently colored plates, which enables the user to easily recognize the guide passages 32. Alternatively, three or more colors may be used for the guide plates 1A, 1B. Of course, all the guide plates 1A, 1B may be made identical in color to each other.

Figure 6:
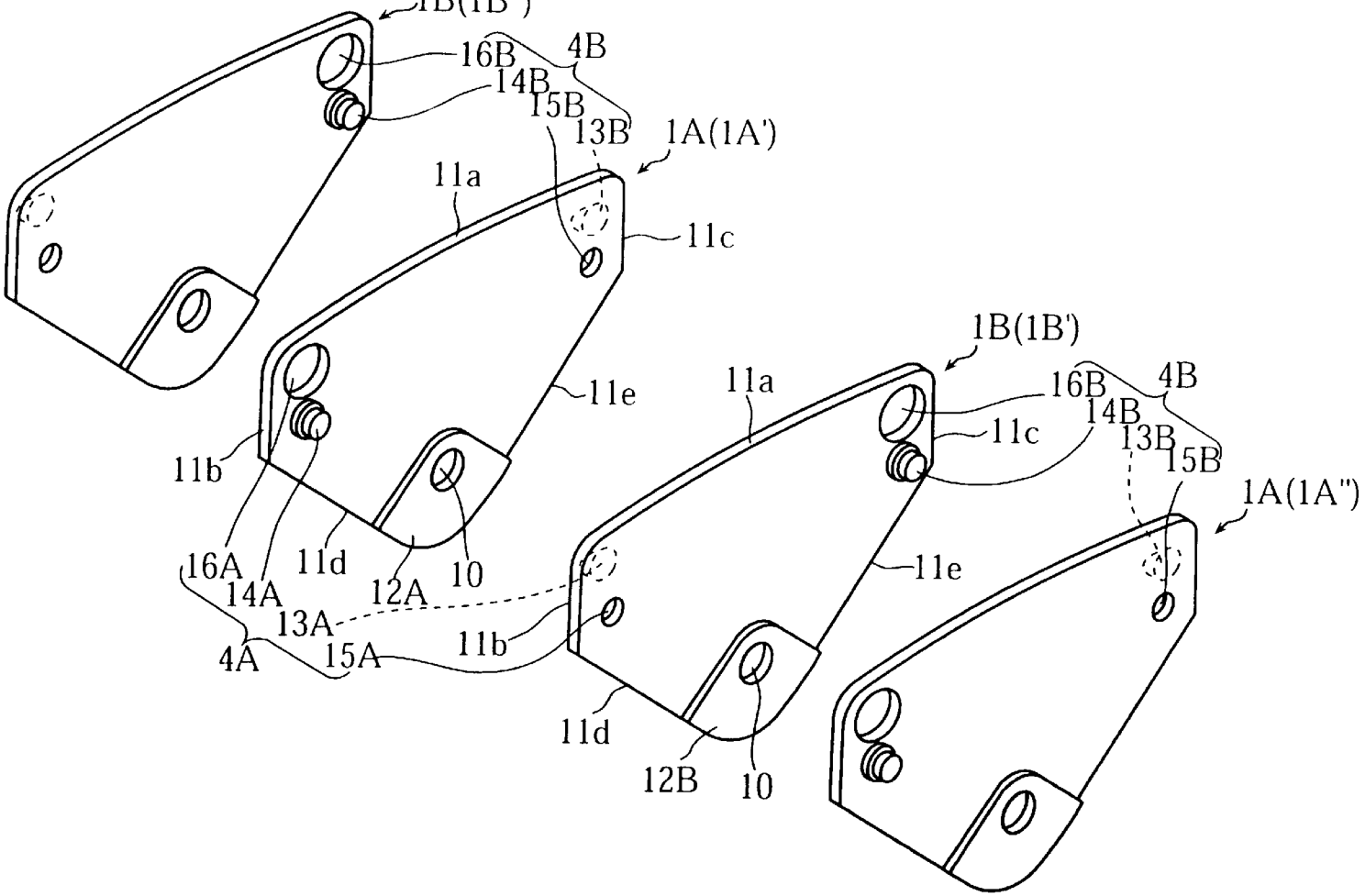
FIG. 6 is an exploded perspective view showing guide plates constituting the heddle.

As shown in FIG. 6, the first guide plates 1A and the second plates 1B are identical in contour. Specifically, the contour of each of the guide plates 1A, 1B is defined by a top edge 11*a*, a pair of lateral edges 11*b*, 11*c*, and a pair of inclined lower edges 11*d*, 11*e* extending toward each other. The lower edges 11*d*, 11*e* are partially curved before meeting each other, thereby providing a rounded bottom of the guide plate 1A, 1B. The above-described contour of the guide plate 1A, 1B is suitable for pivotally tilting the heddle A, as described later. In the case where the bottom of the plate 1A, 1B is chamfered to provide a flat bottom edge, this bottom edge can be brought into surface contact with rails 70 for stable sliding, as also described later.

As shown in FIG. 5, the guide passages 32 are alternately provided with first retainers 4A and second retainers 4B for retaining warps W. Specifically, as shown in FIG. 6, each of the second guide plates 1B is formed with an upper projection 13A and a lower hole 15A adjacent the top edge 11*a* and the lateral edge 11*b*. On the other hand, each of the first guide plates 1A is formed with a lower projection 14A and an upper hole 16A adjacent the top edge 11*a* and the lateral edge 11*b*. Each of the first retainers 4A is provided by attaching the first guide plate 1A to the second guide plate 1B so that the upper projection 13A is loosely received in the upper hole 16A while the lower projection 14A is snuggly fitted in the lower hole 15A.

Figure 7:
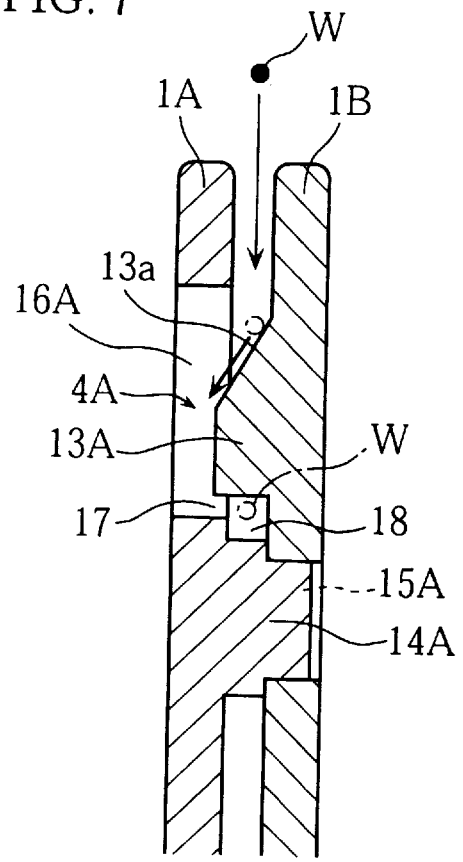
FIG. 7 is a sectional view showing a principal portion of a first retainer provided in the heddle.

More specifically, as shown in FIG. 7, the upper projection 13A has a top portion which is obliquely cut away to provide an inclined surface 13*a* extending downwardly toward the tip. The tip of the upper projection 13A is loosely received in the upper hole 16A of the first guide plate 1A, thereby providing a clearance 17 for allowing passage of the warp W. Each of the upper hole 16A and the lower hole 15A is only an example of cutout for receiving the tip of the corresponding projection 13A, 14A according to the present invention. The cutout may comprise a through-hole or a bottomed hole. The lower projection 14A of the first guide plate 1A has a tip snuggly fitted in the lower hole 15A of the second guide plate 1B. The lower projection 14A is downwardly spaced from the upper projection 13A so as to define a retaining space 18 for retaining the warp W below the upper projection 13A.

Referring again to FIG. 6, each of the first guide plates 1A is also formed with an upper projection 13B and a lower hole 15B adjacent the top edge 11*a* and the lateral edge 11*c* (opposite to the counterpart lateral edge 11*b*). On the other hand, each of the second guide plates 1B is also formed with a lower projection 14B and an upper hole 16B arranged adjacent the top edge 11*a* and the lateral edge 11*c*. Thus, each of the second retainers 4B is defined by attaching the first guide plate 1A to the second plate 1B so that the upper projection 13B is loosely received in the upper hole 16B while the lower projection 14B is snuggly fitted in the lower hole 15B.

Figure 8:
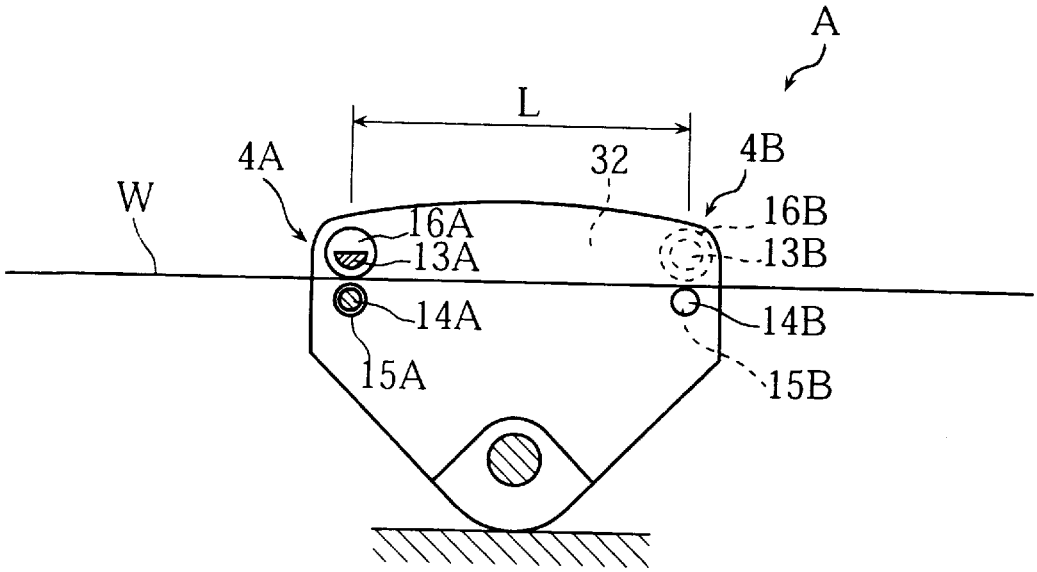
FIG. 8 is a cross sectional view of the heddle held in an upright position.

The configuration and size of the projections 13B, 14B and the holes 15B, 16B of the second retainer 4B are identical to those of the projections 13A, 14A and the holes 15A, 16A of the first retainer 4A. Moreover, the sectional structure of the second retainer 4B is identical to that of the first retainer 4A. However, the first retainer 4A and the second retainer 4B are arranged alternately in the guide passages 32. As shown in FIG. 8, the first retainer 4A and the second retainer 4B are spaced from each other by a predetermined distance L transversely of the shaft 30.

As shown in FIGS. 1 and 2, the loom B of this embodiment includes, in addition to the above-described heddle A, an elongate frame 5, a warp winder 6A, a fabric winder 6B, a pair of rails 70, and other parts which will be described later.

The frame 5 is made of wood or synthetic resin. The frame 5 includes a pair of elongate side plates 50 and a connecting plate 51 bridging the paired side plates 50.

The warp winder 6A holds excessive portion of the warp W as wound therearound. The warp winder 6A is provided with a winding roller 60A extending to bridge the side plates 50 at one end of the frame 5. The winding roller 60A is provided, at each end thereof, with an arm 61A for rotation with the winding roller 60A. Further, an auxiliary bar 62A is held between the paired arms 61A. The auxiliary bar 62A may be utilized in tensioning the warps W between the warp winder 6A and the fabric winder 6B. For example, the warp W extending from the fabric winder 6B toward the warp winder 6A may be first wound around the auxiliary bar 62A for engagement therewith. By rotating the winding roller 60A and the auxiliary bar 62A with the warp W wound around the auxiliary bar 62A, it is possible to wind the warp W around these members. The auxiliary bar 62A, as held between the arms 61A, is movable toward and away from the winding roller 60A.

The winding roller 60A is provided, at opposite ends thereof, with knobs 63A for rotating the roller 60A. For preventing the warps W from being unintentionally paid out from the warp winder 6A, the winding roller 60A is further provided with a ratchet mechanism 64A comprising a ratchet gear 64*a* and a ratchet pawl 64*b*.

The fabric winder 6B is provided for winding a fabric woven from the warps W and wefts Wo. The fabric winder 6B has a structure similar to that of the warp winder 6A. Specifically, the fabric winder 6B is provided with an elongate winding roller 60B extending to bridge the side plates 50 at the other end of the frame 5, an arm 61B provided at each end of the winding roller 60B, and an auxiliary bar 62B held between the opposite arms 61B. Further, the fabric winder 6B is provided with knobs 63B for rotating the roller 60B, and a ratchet mechanism 64B. Each of the above-described parts is similar in structure to a corresponding one of the warp winder 6A. Thus, by rotating the auxiliary bar 62B together with the winding roller 60B with the warp W wound around the auxiliary bar 62B, it is possible to wind the fabric around these members.

Figure 11:
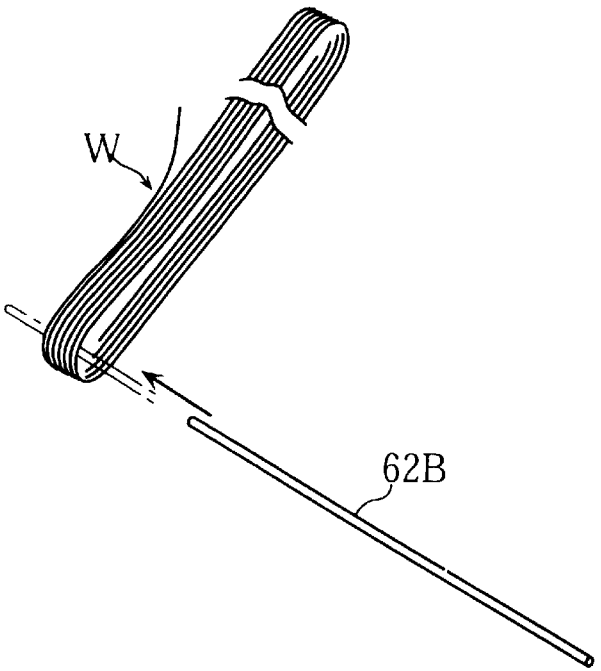
FIG. 11 is a perspective view illustrating an auxiliary bar to be inserted into a hank of a warp.

Preferably, the auxiliary bar 62B is removable from the arms 61B. As shown in FIG. 11, the auxiliary bar 62B removed from the arms 61B may be inserted into a hank of the warp W for example and then returned to be held between the arms 61B. By this operation, it is possible to easily provide the state in which the warp W is wound around the auxiliary bar 62B. Similarly, the auxiliary bar 62A of the warp winder 6A may be removable from the arms 61A.

The heddle A is carried on the paired rails 70 for sliding movement. Each of the rails 70 is attached to the inner surface of a respective side plate 50. The rail 70 extends generally horizontally from a longitudinally intermediate portion of the side plate 50 to a portion adjacent the fabric winder 6B.

The heddle A can be disposed on the paired rails 70 with the guide passages 32 aligned widthwise of the frame 5. The heddle A can be handled independently from the other parts of the loom B so as to be freely disposed on and removed from the rails 70. On the rails 70, the heddle A is pivotable about the bottom portion thereof in the arrow Na directions shown in FIG. 3.

The loom B is further provided with a support member 71*a* which bridges the paired side plates 50 at a portion inward from the warp winder 6A. Further, each of the side plates 50 is provided, on the inner surface thereof, with a projection 71*b* spaced from the support member 71*a*. The support member 71*a* together with the opposite projections 71*b* constitute a rest for holding the heddle A in a non-pivoted state, as indicated by reference sign n1 in FIG. 3.

Next, the operation of the loom B will be described.

First, a plurality of warps W are extended generally in parallel with each other between the warp winder 6A and the fabric winder 6B. At this time, as indicated by n1 in FIG. 3, the heddle A keeps a non-inclined posture as held by the support member 71*a* and the projections 71*b*, and the warps W are guided into the respective guide passages 32 of the heddle A. In this state, each of the warps W is retained by the first retainer 4A or the second retainer 4B provided in a corresponding guide passage 32.

This operation can be easily performed by putting each of the warps W into a corresponding guide passage 32 from above while extending the warp generally horizontally. Specifically, as shown in FIG. 7, when the warp W is inserted into the guide passage 32, the warp W reaches the inclined surface 13*a* of the upper projection 13A of the first retainer 4A. The warp W then slides down over the inclined surface 13*a* and is guided through the clearance 17 to a position under the upper projection 13A. In this way, the warp W is retained in the retaining space 18 between the upper projection 13A and the lower projection 14A. The warp W is held in the retaining space 18 with a certain play. In this way, the warp W is restricted from coming out of the guide passage 32. The second retainer 4B also works to retain the warp W in a similar manner.

Once the warp W is retained in the first retainer 4A or the second retainer 4B, the warp W does not easily come off from the first or the second retainers 4A, 4B. Specifically, as shown in FIG. 7, in order to come off from the retainer 4A (or 4B), the warp W located in the retaining space 18 needs to pass over the upper projection 13A (or 13B). However, since the tip of the upper projection 13A (or 13B) is inserted in the upper hole 16A (or 16B), the warp W cannot pass over the upper projection 13A (or 13B) just by pulling the warp W directly upward. Therefore, it is possible to prevent the warp W from easily coming off from the first or the second retainer 4A 4B even when the heddle A is moved.

Figure 9:
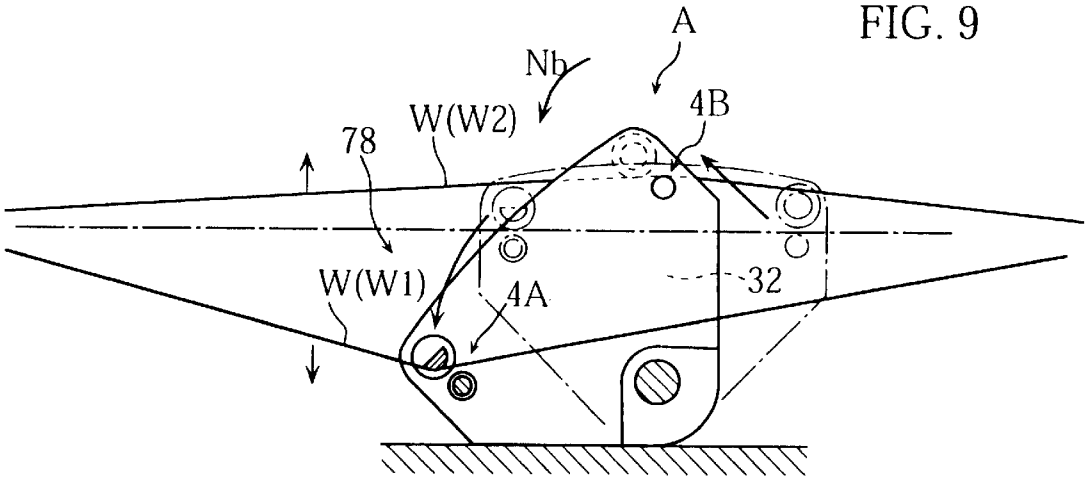
FIG. 9 illustrates the heddle pivoted in one direction.

Subsequently, the heddle A is shifted onto the paired rails 70 and pivoted for performing weaving. As shown in FIG. 9, when the heddle A is pivoted in the arrow Nb direction, the first retainers 4A shift to lower positions, thereby lowering the warps W1 held therein, whereas the second retainers 4B shift to higher positions, thereby lifting the warps W2 held therein. As a result, difference in height is generated between the warps W1 and the warps W2, thereby defining a shuttle passage 78 between the warps W1 and the warps W2. In this state, a shuttle 79 connected with a weft Wo (see FIG. 2) is guided into the shuttle passage 78. In this way, according to the present invention, the shuttle passage 78 is sufficiently expanded to facilitate guiding the shuttle 79 together with the weft Wo into the shuttle passage 78.

Conversely, when the heddle A is pivoted in the opposite direction (the arrow Nc direction in FIG. 10), the warps W2 are lowered while the warps W1 are lifted. Therefore, also in this case, it is possible to widen the shuttle passage 78.

Figure 10:
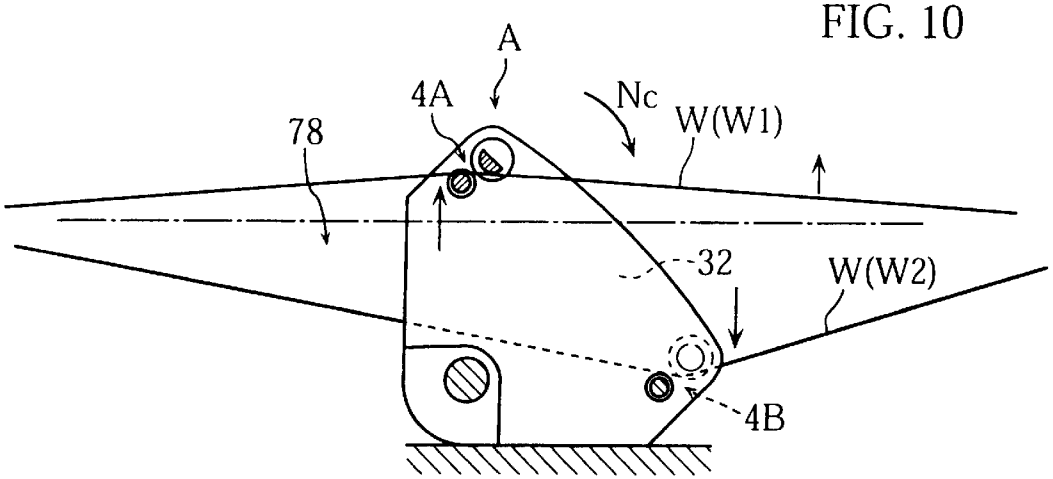
FIG. 10 illustrates the heddle pivoted in an opposite direction.

As described before, the first retainers 4A and the second retainers 4B are alternately arranged, so that the pivotal movement of the heddle A alternately lifts and lowers the warps W. Therefore, by guiding the weft Wo into the shuttle passage, it is possible to pass the weft Wo crosswise alternately over and under the warps. In this way, plain weaving is easily performed. Moreover, since the heddle A can be pivoted about a certain point as the center of pivotal movement as shown in FIGS. 9 and 10, the user can easily operate the heddle A without the need for lifting the heddle A.

Passing of the weft Wo is performed every time a shuttle passage 78 is formed. By utilizing the heddle A as a reed, the weft Wo is pushed toward the previously woven fabric portion every time it is passed through the shuttle passage 78. Specifically, this operation is performed by returning the heddle A to the initial non-pivoted posture and then sliding the heddle A along the rails 70 toward the woven fabric portion. At this time, the weft Wo is kept in contact with the lateral edges 11*b* of the heddle A. Since the lateral edges 11*b* are straight and held vertical, it is possible to positively push the weft Wo. In this way, by sliding the heddle A on the rails 70, the heddle A can be utilized as the reed so that it is possible to push the weft easily and positively.

FIGS. 12–15 illustrate another embodiment of a loom according to the present invention. In these figures, the elements which are identical or similar to those of the above-described embodiment are designated by the same reference signs as those used for the above-described embodiment.

Figure 12:
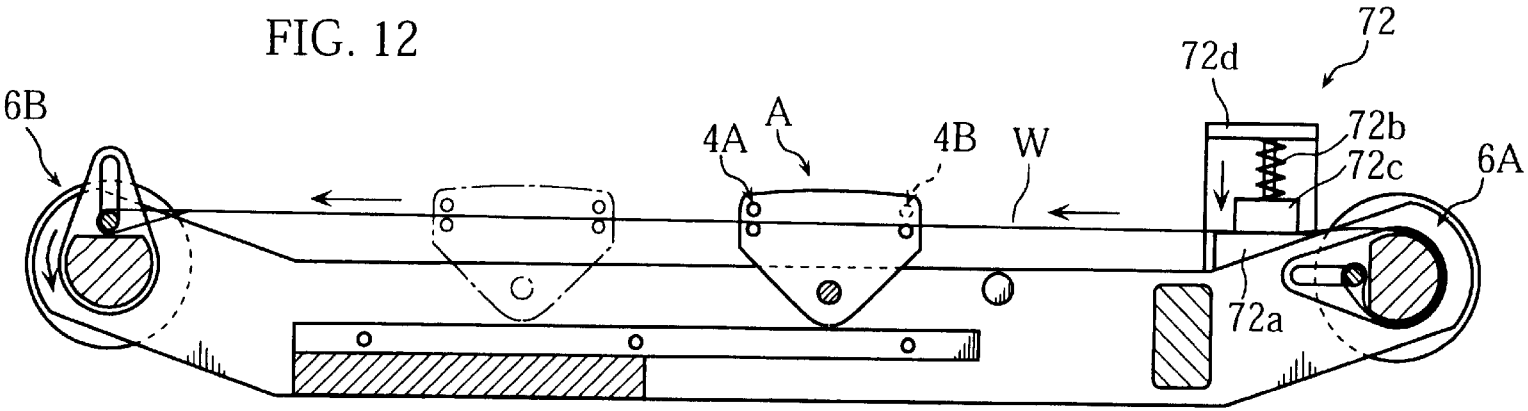
FIG. 12 is a sectional view showing another loom embodying the present invention.

In the embodiment shown in FIG. 12, a clamp mechanism 72 for clamping the warps W from above and below with an appropriate force is provided between a warp winder 6A and a heddle A. The clamp mechanism 72 comprises a bearing base 72*a* for supporting the warps W from below, a presser 72*c* for pressing the warps W against the bearing base 72*a*, a spring 72*b* for downwardly biasing the presser 72*c*, and a support frame 72*d* for supporting the presser 72*c*. Preferably, the parts of the clamp mechanism 72 other than the bearing base 72*a* are detachable from the frame 5 so as not to hinder the operation of tensioning the warps W between the warp winder 6A and the fabric winder 6B for example. The clamp mechanism 72 clamps the warps W with a force which allows longitudinal movement of the warps W. The upper surface of the bearing base 72*a* and the lower surface of the presser 72*c* are made of a relatively soft material such as rubber or felt so as to press all of the warps W generally uniformly without making any damage thereto.

With this arrangement, in winding the warps W around the warp winder 6B, the clamp mechanism 72 provides resistance against the winding. As a result, the warps W are stretched between the clamp mechanism 72 and the fabric winder 6B with a relatively strong tension. Therefore, it is possible to prevent the warps W from getting loose.

Figure 13:
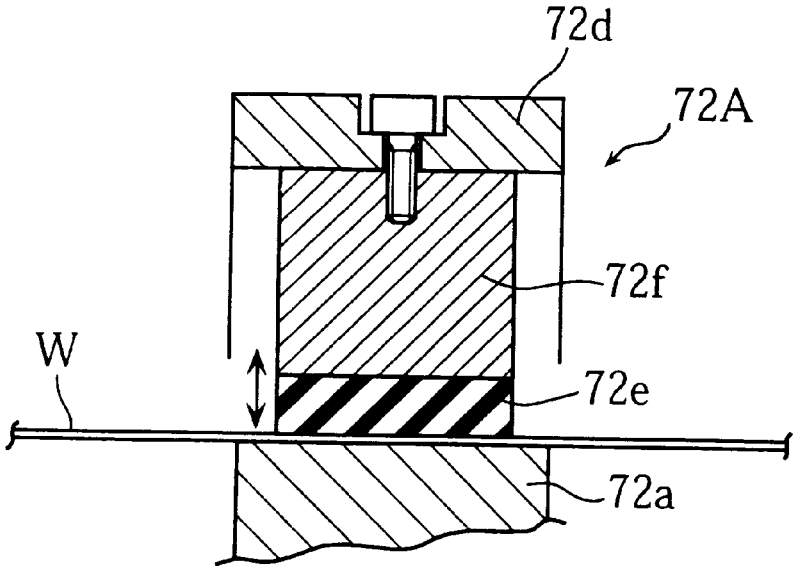
FIG. 13 is a sectional view showing a principal portion of still another loom embodying the present invention.

FIG. 13 illustrates another example of clamp mechanism. In the illustrated clamp mechanism 72A, a rubber member 72*e* and a presser 72*f* are interposed between a support frame 72*d* and a bearing base 72*a*. The rubber member 72*e* is appropriately deformed by compression between the presser 72*f* and the bearing base 72*a*. With this structure, by utilizing the reaction of the compressed rubber member 72*e* between the presser 72*f* and the bearing base 72*a*, it is possible to clamp the warps W between the rubber member 72*e* and the bearing base 72*a* with an appropriate force. This clamp mechanism 72A also enjoys the same advantages as the clamp mechanism 72 shown in FIG. 12. The clamp mechanism 72A shown in FIG. 13 is simple in structure as compared to the clamp mechanism 72 shown in FIG. 12 in which the presser 72*c* is held vertically movable as downwardly biased by the spring 72*b*. Therefore, the clamp mechanism 72A is preferable in simplifying the structure of the loom.

Figure 14:
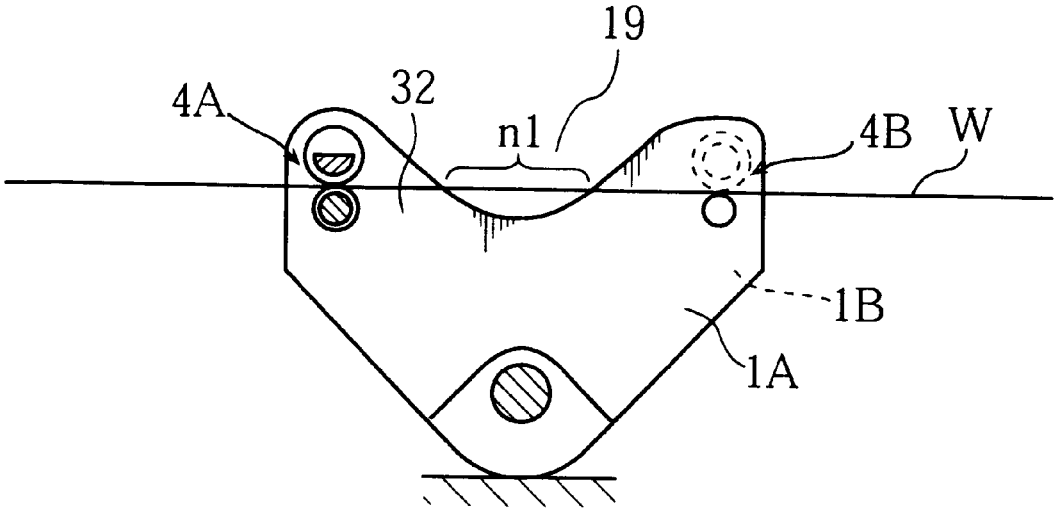
FIG. 14 is a cross sectional view showing another heddle embodying the present invention.

FIG. 14 illustrates another example of heddle A. The illustrated heddle A includes guide plates 1A, 1B each of which is upwardly formed with a recess 19. With this structure, a portion n1 of each of the warps W held in the first retainer 4A or the second retainer 4B is visible from above or beside. This structure is convenient because it is possible to easily check whether the warp W is properly guided in the corresponding guide passage 32.

Figure 15:
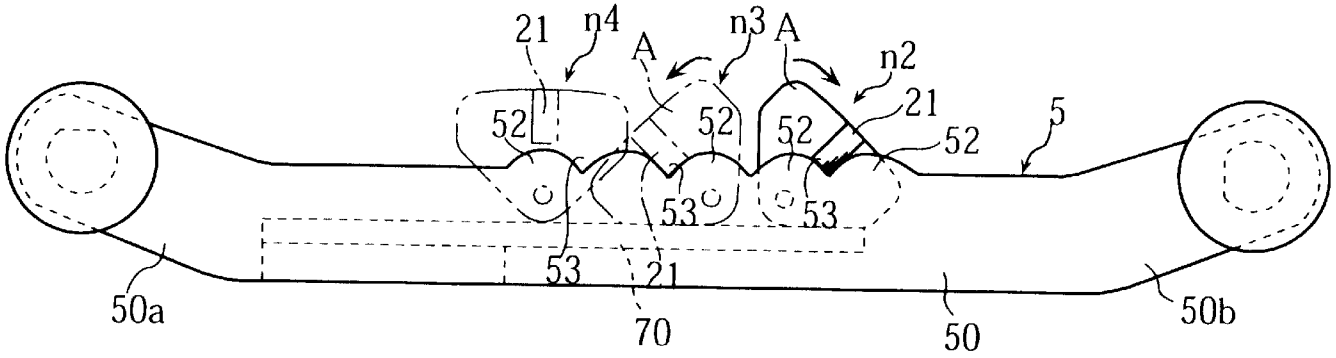
FIG. 15 is a side view showing a further loom embodying the present invention.

FIG. 15 illustrates another embodiment of the present invention wherein a frame 5 includes a pair of side plates 50 each of which is upwardly formed with a plurality of bulging portions 52. Between respective adjacent bulging portions 52, engagement recesses 53 are defined for engagement with a projection 21 at each end of the heddle A. Specifically, when the heddle A is pivoted as indicated by reference signs n2, n3, the projection 21 of the heddle A are brought into engagement with a respective one of the engagement recesses 53 for maintaining the pivoted posture of the heddle A. Each of the bulging portions 52 has such a height as not to interfere with the projection 21 when the heddle A keeps a non-inclined posture.

The loom having the above-described structure may be conveniently used in an inclined state for example wherein one end 50*a* of the frame 5 is placed on the user's knee while the other end 50*b* of the frame 5 is placed on a table located higher than the knee. In this state, when the heddle A is pivoted as indicated by reference signs n2, n3, the projections 21 are brought into engagement with the engagement recesses 53 so that the heddle A is prevented from unintentionally changing its posture or moving longitudinally of the frame 5. Therefore, it is possible to prevent the heddle A from unintentionally sliding toward the end 50*a* of the frame 5. The engagement recess 53 is an example of engaging means of the present invention. However, the engaging means is not limited to such a recess. For example, instead of forming a recess directly on each side plate 50 of the frame 5, another member provided with a recess may be fixed or removably attached to the side plate 50.

The heddle of the present invention need not necessarily comprise a plurality of guide plates aligned with each other. Alternatively, the heddle may comprise a single member formed with a plurality of guide passages or grooves.

Figure 16:
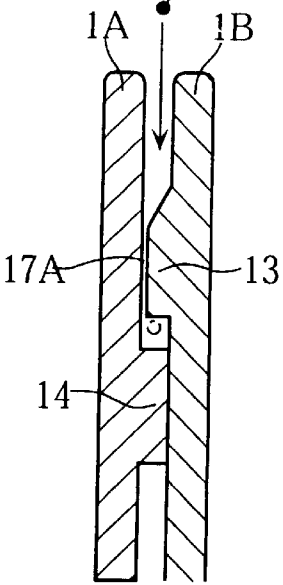
FIG. 16 is a sectional view showing a principal portion of a retainer of still another heddle embodying the present invention.
Figure 17:
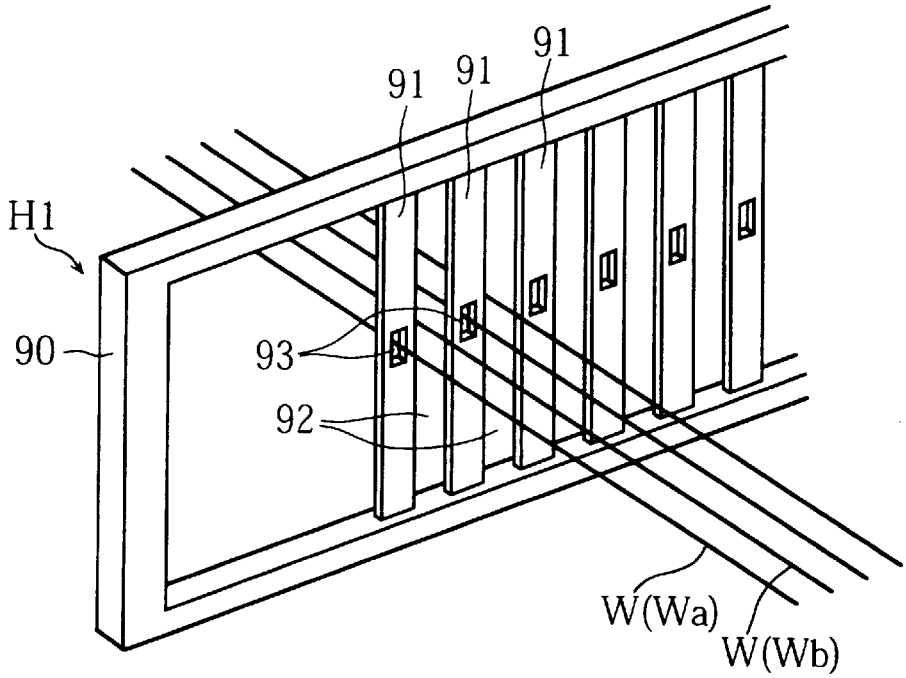
FIG. 17 PRIOR ART
FIG. 17 is a perspective view showing an example of prior art heddle.
Figure 18:
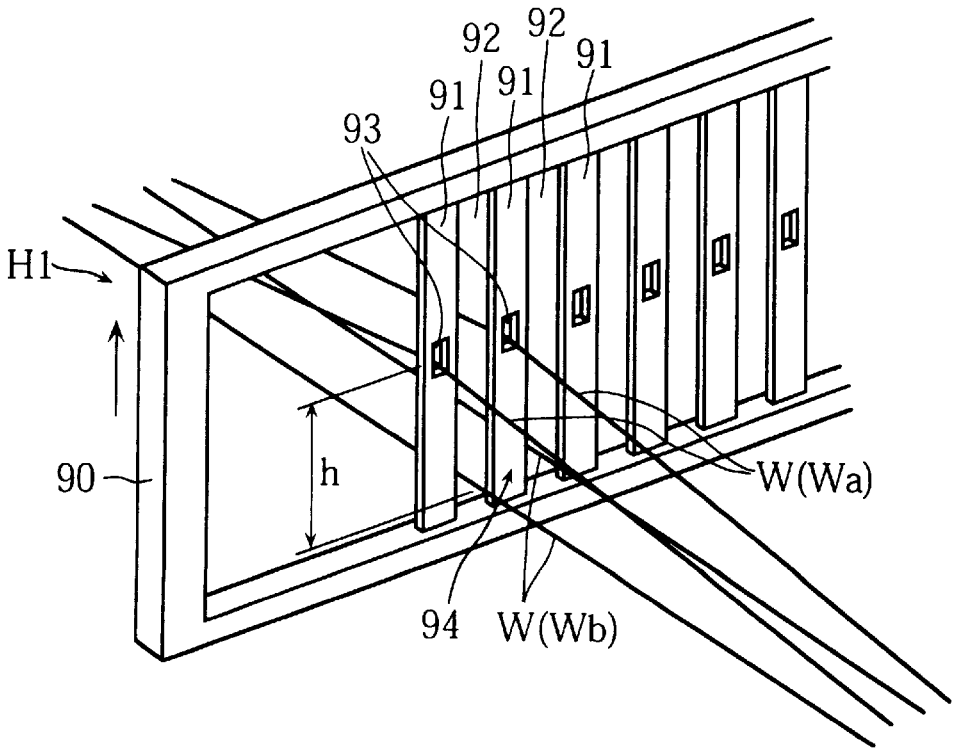
FIG. 18 PRIOR ART
FIG. 18 illustrates the operation of the prior art heddle shown in FIG. 17.
Figure 19:
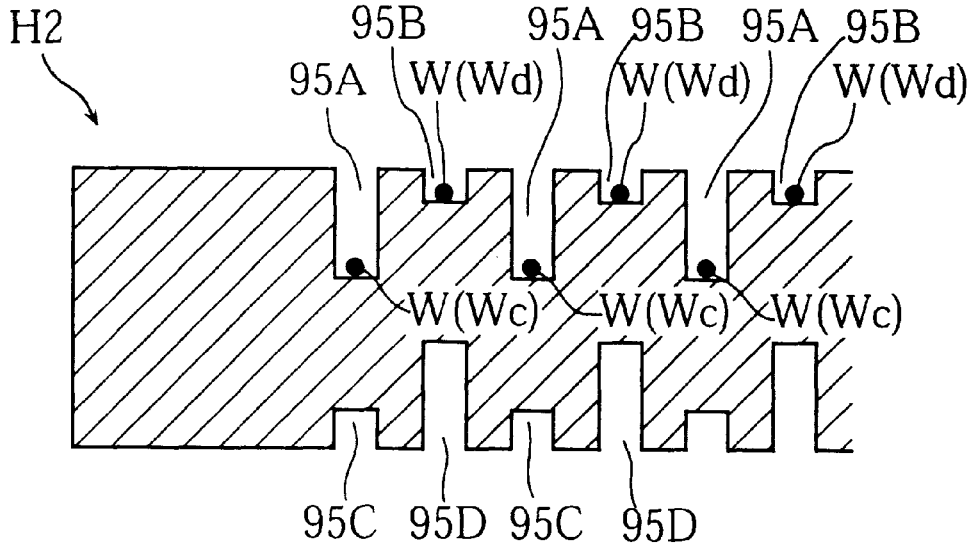
FIG. 19 PRIOR ART
FIG. 19 is a sectional view showing another example of prior art heddle.
Figure 20:
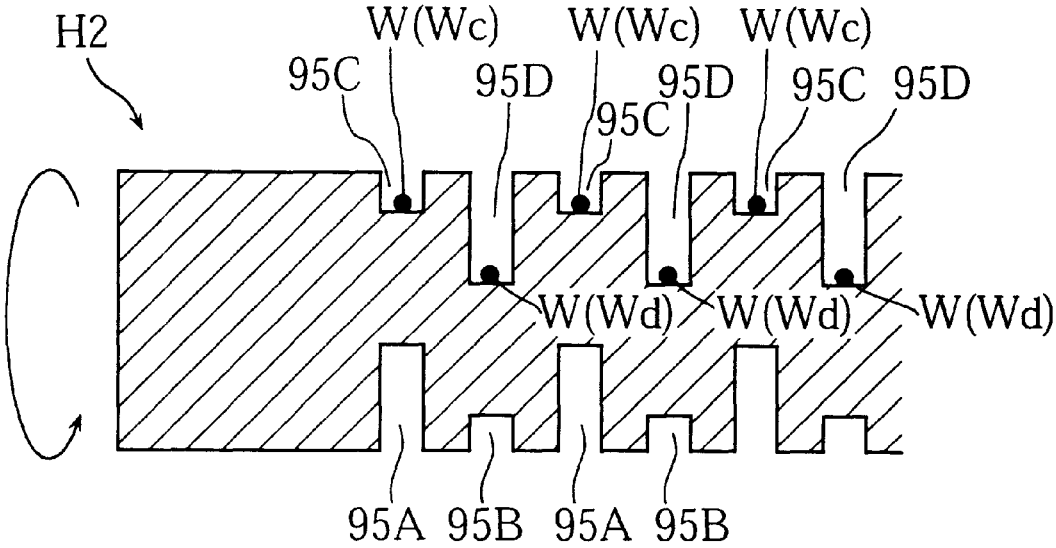
FIG. 20 PRIOR ART
FIG. 20 illustrates the operation of the prior art heddle shown in FIG. 19.

Further, the first and the second retainers 4A, 4B may be modified in design. For example, as shown in FIG. 16, each of the first guide plates 1A may not be formed with an upper hole for receiving a upper projection 13 of the counterpart plate 1B. Instead, only a narrow clearance 17*a* may be defined between the first plate 1A and the upper projection 13 for allowing passage of the warp W. Although the structure shown in FIG. 16 may be disadvantageous in that the warp W is more likely to come off from the guide passage 32 than in the above-described embodiment shown in FIG. 7, this structure may be employed for simplifying the structure of the heddle.

Further, as shown in FIG. 16, each of the second plates 1B may not be formed with a lower hole for receiving a lower projection 14 of the counterpart plate 1A. Instead, the tip of the lower projection 14 may be held in contact with the surface of the second plate 1B facing the lower projection 14.

In the above-described embodiment, the first and the second retainers are alternately arranged longitudinally of the heddle for plain-weaving a fabric. However, the arrangement of the first and the second retainer may be varied for performing weaving other than the plain-weaving.

In the above-described embodiment, the heddle A is pivoted about the bottom portion thereof. Instead, however, the heddle may be supported on the frame 5 of the loom B via a shaft for pivotal movement about the shaft, although in this case the heddle is fixed to the frame and cannot be horizontally moved for serving as a reed.

The warp winder or the fabric winder may comprise a simple roller.

The loom according to the present invention may be suitably used for hand-weaving. However, the loom of the present invention may be provided with a driving mechanism including a power source for performing pivotal movement of the heddle for example.

The present invention being thus described, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A heddle comprising a single stack of guide plates which includes:

a plurality of passages spaced from each other in a first direction for guiding warps, respectively;

a first retainer provided in each of selected ones of the passages for retaining a corresponding warp; and a second retainer provided in each of the other passages for retaining a corresponding warp;

wherein the first retainer and the second retainer are spaced from each other in a second direction transverse to the first direction for causing one of the first retainer and the second retainer to lift the corresponding warp while causing the other of the first retainer and the second retainer to lower the corresponding warp when the single stack of guide plates is pivoted in one direction about an axis extending in the first direction.

2. The heddle according to claim 1, wherein the first retainer and the second retainer are arranged alternate with each other.

3. The heddle according to claim 1, wherein each of the guide passages is defined between a first guide plate and a second guide plate; and wherein each of the first retainer and the second retainer includes an upper projection extending between the first guide plate and the second guide plate, and a lower projection extending between the first guide plate and the second guide plate, the upper projection and the lower projection defining a warp retaining space which is accessible from the guide passage via a clearance.

4. The heddle according to claim 3, wherein the upper projection has an inclined surface for slidably guiding the warp toward the warp retaining space.

5. The heddle according to claim 3, wherein the upper projection projects from one of the first guide plate and the second guide plate toward the other of the first guide plate and the second guide plate, said other of the first guide plate and the second guide plate being provided with a cutout for loosely receiving the upper projection.

6. The heddle according to claim 5, wherein said cutout comprises a hole formed in said other of the first guide plate and the second guide plate for loosely receiving the upper projection.

7. The heddle according to claim 3, wherein the lower projection projects from one of the first guide plate and the second guide plate into contact with the other of the first guide plate and the second guide plate.

8. The heddle according to claim 7, wherein said cutout comprises a hole formed in said other of the first guide plate and the second guide plate for snuggly receiving the lower projection.

9. The heddle according to claim 3, wherein each of first guide plate and the second guide plate includes a top edge, a first lateral edge extending downwardly from the top edge, and a second lateral edge extending downwardly from the top edge and spaced from the first lateral edge in the second direction; and wherein the first retainer is located adjacent the top edge and the first lateral edge while the second retainer is located adjacent the top edge and the second lateral edge.

10. The heddle according to claim 3, wherein each of first guide plate and the second guide plate further includes a rounded bottom edge about which the heddle is pivotable.

11. A heddle comprising a single stack of guide plates which includes:

a plurality of passages spaced from each other in a first direction for guiding warps, respectively; and a retainer provided in each of the passages for retaining a corresponding warp;

wherein each of the guide passages is defined between a first surface and a second surface; and wherein the retainer includes an upper projection extending between the first surface and the second surface for engagement with the warp from above, and a lower projection extending between the first surface and the second surface for engagement with the warp from below, the upper projection and the lower projection defining a warp retaining space which is accessible from the guide passage via a clearance.

12. A loom comprising:

a frame; and a heddle supported on the frame;

wherein the heddle comprises a single stack of guide plates which includes:

a plurality of passages spaced from each other in a first direction for guiding warps, respectively;

a first retainer provided in each of selected ones of the passages for retaining a corresponding warp; and a second retainer provided in each of the other passages for retaining a corresponding warp;

wherein the first retainer and the second retainer are spaced from each other in a second direction transverse to the first direction for causing one of the first retainer and the second retainer to lift the corresponding warp while causing the other of the first retainer and the second retainer to lower the corresponding warp when the single stack of guide plates is pivoted in one direction about an axis extending in the first direction.

13. The loom according to claim 12, further comprising:

a warp winder mounted on the frame; and a fabric winder spaced from the warp winder in the second direction.

14. The loom according to claim 13, further comprising a heddle supporting member for supporting the heddle between the warp winder and the fabric winder with the first retainer and the second retainer kept generally equal in height.

15. The loom according to claim 13, wherein the heddle is movable in the second direction toward and away the fabric winder.

16. The loom according to claim 13, further comprising a rail for coming into contact with a bottom portion of the heddle for guiding the heddle in the second direction.

17. The loom according to claim 13, wherein the frame is provided with engaging means for engaging the heddle to prevent the heddle from moving in the second direction when the heddle is pivoted.

18. The loom according to claim 13, further comprising a clamp for clamping the warps from above and below to generate resistance when the warps are pulled toward the fabric winder.

* * * * *